US012557917B2

(12) United States Patent
Chunglo

(10) Patent No.: US 12,557,917 B2
(45) Date of Patent: Feb. 24, 2026

(54) MATTRESS ASSEMBLIES INCLUDING PHASE CHANGE MATERIALS

(71) Applicant: DREAMWELL, LTD., Doraville, GA (US)

(72) Inventor: Christopher Chunglo, Marietta, GA (US)

(73) Assignee: DREAMWELL, LTD., Doraville, GA (US)

( * ) Notice: Subject to any disclaimer, the term of this patent is extended or adjusted under 35 U.S.C. 154(b) by 26 days.

(21) Appl. No.: 17/479,622

(22) Filed: Sep. 20, 2021

(65) Prior Publication Data

US 2023/0087762 A1 Mar. 23, 2023

(51) Int. Cl.

| | |
|---|---|
| ***A47C 27/08*** | (2006.01) |
| ***A47C 21/04*** | (2006.01) |
| ***A47C 27/14*** | (2006.01) |
| ***A47C 27/15*** | (2006.01) |

(52) U.S. Cl.

CPC ..... *A47C 27/085* (2013.01); *A47C 21/042* (2013.01); *A47C 21/046* (2013.01); *A47C 21/048* (2013.01); *A47C 27/144* (2013.01); *A47C 27/15* (2013.01)

(58) Field of Classification Search

CPC ..... A47C 27/085; A47C 21/046; A47C 27/14; A47C 27/146; A47C 27/148; A47C 27/086; A47C 27/15; A47C 27/16; A47C 27/142; A47C 27/144; A47C 21/048; A47C 27/05; A47C 27/053; A47C 27/056; B68G 7/06; A61F 2007/0292; A61F 2007/0293

USPC ..... 5/690, 691, 724, 739, 636, 638, 655.5, 5/655.9, 709, 740

See application file for complete search history.

(56) References Cited

U.S. PATENT DOCUMENTS

| | | | | |
|---|---|---|---|---|
| 6,319,599 | B1 * | 11/2001 | Buckley | C09K 5/063 36/83 |
| 8,832,888 | B2 * | 9/2014 | Chunglo | A47C 27/146 5/724 |
| 2013/0025065 | A1 * | 1/2013 | Chunglo | A47C 27/144 5/691 |
| 2017/0020299 | A1 * | 1/2017 | Valenta | A47C 21/046 |
| 2017/0055719 | A1 * | 3/2017 | Booska | A47C 21/046 |
| 2020/0260882 | A1 * | 8/2020 | Chunglo | A47C 27/148 |

FOREIGN PATENT DOCUMENTS

| | | | | |
|---|---|---|---|---|
| CA | 2885402 | A1 * | 1/2014 | A47C 21/042 |
| WO | WO-2015160337 | A1 * | 10/2015 | A47C 27/085 |
| WO | WO-2020168040 | A1 * | 8/2020 | A47C 21/046 |

* cited by examiner

*Primary Examiner* — Justin C Mikowski
*Assistant Examiner* — Deborah Talitha Gedeon
(74) *Attorney, Agent, or Firm* — CANTOR COLBURN LLP

(57) ABSTRACT

Mattress assemblies including at least one foam layer at or proximate to a sleeping surface including a plurality of channels or recesses in at least one surface, wherein at least a portion of the channels include an encapsulated bulk phase change material at least partially filling the channel or the recesses.

17 Claims, 8 Drawing Sheets

MATTRESS ASSEMBLIES INCLUDING PHASE CHANGE MATERIALS

BACKGROUND

The present disclosure generally relates to mattress assemblies including phase change materials.

Phase change is a term used to describe a reversible process in which a solid turns into a liquid or a gas. The process of phase change from a solid to a liquid requires energy to be absorbed by the solid. When a phase change material ("PCM") liquefies, energy is absorbed from the immediate environment as it changes from the solid to the liquid. In contrast to a sensible heat storage material, which absorbs and releases energy essentially uniformly over a broad temperature range, a phase change material absorbs and releases a large quantity of energy in the vicinity of its melting/freezing point. Therefore, a PCM that melts below body temperature would feel cool as it absorbs heat, for example, from a body. Phase change materials, therefore, include materials that liquefy (melt) to absorb heat and solidify (freeze) to release heat. The melting and freezing of the material typically take place over a narrow temperature range.

PCMs have been used in various applications ranging from household insulation to clothing. Dispersal in preformed foams is expensive, involves an additional step after formation of the foam, and typically does not uniformly distribute the PCMs throughout foams greater than one inch in thickness. In these types of applications, the PCM is microencapsulated. Typically, the PCM material itself is a relatively inexpensive long chain hydrocarbon that is subsequently microencapsulated. Exemplary long chain hydrocarbons include octadecane, nonadecane, icosane, heptadecane, and the like. These materials have low melting point temperatures. However, as noted above, the microencapsulation process dramatically increases the price of the PCM. As one decreases the overall size of the microencapsulated PCM, the net volume of the PCM within the microencapsulated PCM significantly decreases whereas the volume taken up by the capsule increases. With respect to mattress assemblies, microencapsulated PCMs are typically provided on a foam surface.

BRIEF SUMMARY

Disclosed herein are mattress assemblies including at least one foam layer proximate to a sleeping surface of the mattress assembly, the at least one foam layer spanning at least a portion of the length and/or width of the sleeping surface and including a plurality of channels in at least a top surface, wherein the top surface faces the sleeping surface; and an encapsulated bulk phase change material at least partially filling one or more of the channels, wherein the encapsulated bulk phase change material comprises a sealed flexible capsulate containing a phase change material or a mixture of phase change materials.

In one or more other embodiments, the mattress assembly includes an upper foam layer and a lower foam layer coupled to the upper foam layer, wherein the upper and lower foam layers are proximate to a sleeping surface of the mattress assembly and span at least a portion of the length and/or width of the sleeping surface, wherein the upper foam layer comprises a top surface and a bottom surface, wherein the top surface comprises a plurality of channels and an encapsulated bulk phase change material at least partially filling one or more of the channels, wherein the encapsulated bulk phase change material comprises a sealed flexible capsulate containing a phase change material or a mixture of phase change materials, and wherein the second foam layer comprises a top surface and a bottom surface, wherein the top surface comprises a plurality of channels and the encapsulated bulk phase change material at least partially filling one or more of the channels, wherein the plurality of channels are internally located within the coupled upper and lower foam layers such that the bottom surface of the second foam layer is free of channels.

In still one or more other embodiments, the mattress assembly includes an upper foam layer and a lower foam layer coupled to the upper foam layer, wherein the upper and lower foam layers are proximate to a sleeping surface of the mattress assembly and span at least a portion of the length and/or width of the sleeping surface, wherein the upper foam layer comprises a top surface and a bottom surface, wherein the top surface comprises a plurality of channels and an encapsulated bulk phase change material at least partially filling one or more of the channels, wherein the encapsulated bulk phase change material comprises a sealed flexible capsulate containing a phase change material or a mixture of phase change materials, and wherein the second foam layer comprises a top surface and a bottom surface, wherein the bottom surface comprises a plurality of channels and the encapsulated bulk phase change material at least partially filling one or more of the channels.

In still one or more other embodiments, the mattress assembly includes at least one foam layer proximate to a sleeping surface of the mattress assembly, the at least one foam layer spanning at least a portion of the length and/or width of the sleeping surface and including a plurality of recesses in at least a top surface or in a layer near the top surface, wherein the top surface faces the sleeping surface; and an encapsulated bulk phase change material at least partially filling one or more of the recesses, wherein the encapsulated bulk phase change material comprises a sealed flexible capsulate containing a phase change material or a mixture of phase change materials.

The disclosure may be understood more readily by reference to the following detailed description of the various features of the disclosure and the examples included therein.

BRIEF DESCRIPTION OF THE DRAWINGS

Referring now to the figures wherein the like elements are numbered alike.

DETAILED DESCRIPTION

Figure 1:
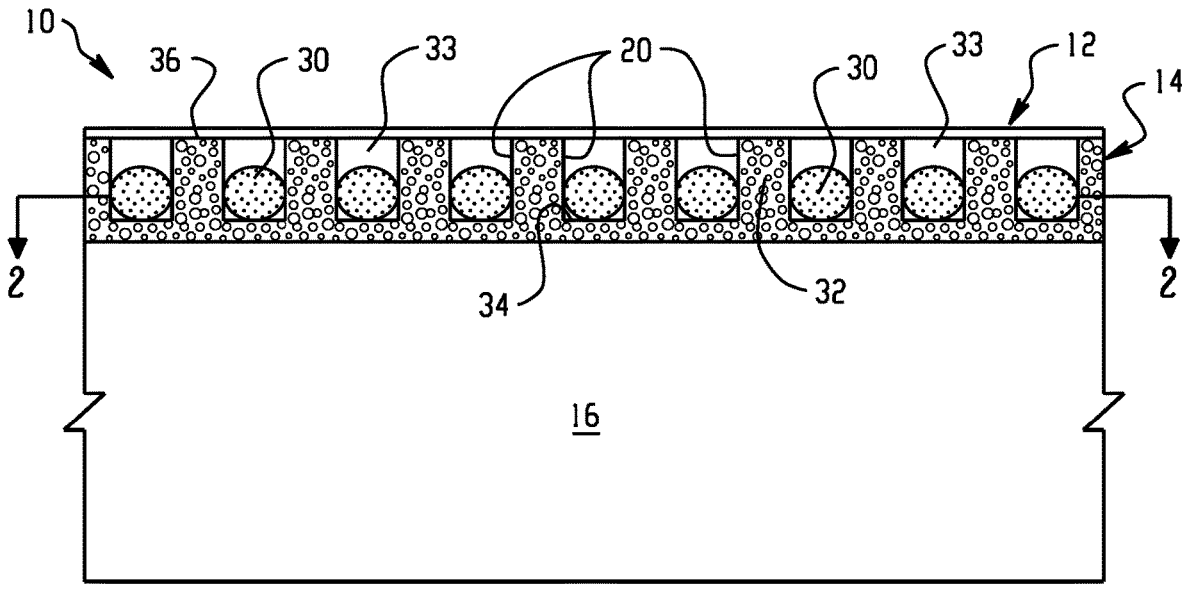
FIG. 1 illustrates a cross-sectional view of a mattress assembly including at least one layer including channels and an encapsulated bulk phase change material within the channels in accordance with an embodiment of the present disclosure.

Disclosed herein are mattress assemblies including at least one layer including a plurality of channels, wherein one or more of the channels include an encapsulated bulk amount of phase change material or materials at least partially or completely filling the channel. As will be discussed in greater detail below, the mattress assemblies including the at least one layer as generally described above provides marked improvements in heat absorption, heat flux, and heat index.

The at least one layer including the plurality of channels with at least a portion of the channels including the encapsulated bulk phase change material(s) can be located at or proximate to a sleeping surface and may span the length and/or width of the sleeping surface or a portion thereof to define one or more zones. By way of example, the at least one layer can be used to define a topper layer that is typically positioned at or in close proximity to the sleeping surface. The phase change material can be a single phase change material or mixtures of phase change materials, wherein the mixtures can include different phase change materials having similar or different transition temperatures. Moreover, each encapsulated bulk phase change material disposed within a given channel can have similar or different amounts of the phase change materials depending its location relative to the sleeping surface, and/or the encapsulated bulk phase change material can have similar and/or different shapes and/or dimensions.

As used herein, the term "transition time" generally refers to the time of the transition of the phase change material per unit cell volume of the phase change material during use by an end user on the mattress. For example, an end user would feel cool as the phase change material absorbs heat from the end user during the sleep cycle. In the present disclosure, an encapsulated bulk amount of phase change material or materials provided within a channel can be calculated to provide cooling or heating from about 30 minutes to about 8 hours or longer.

For the purposes of the description hereinafter, the terms "upper", "lower", "top", "bottom", "left," and "right," and derivatives thereof shall relate to the described structures, as they are oriented in the drawing figures. The same numbers in the various figures can refer to the same structural component or part thereof. Additionally, the articles "a" and "an" preceding an element or component are intended to be nonrestrictive regarding the number of instances (i.e. occurrences) of the element or component. Therefore, "a" or "an" should be read to include one or at least one, and the singular word form of the element or component also includes the plural unless the number is obviously meant to be singular.

Spatially relative terms, e.g., "beneath," "below," "lower," "above," "upper," and the like, can be used herein for ease of description to describe one element or feature's relationship to another element(s) or feature(s) as illustrated in the figures.

The following definitions and abbreviations are to be used for the interpretation of the claims and the specification. As used herein, the terms "comprises," "comprising," "includes," "including," "has," "having," "contains" or "containing," or any other variation thereof, are intended to cover a non-exclusive inclusion. For example, a composition, a mixture, process, method, article, or apparatus that comprises a list of elements is not necessarily limited to only those elements but can include other elements not expressly listed or inherent to such composition, mixture, process, method, article, or apparatus.

As used herein, the term "about" modifying the quantity of an ingredient, component, or reactant of the invention employed refers to variation in the numerical quantity that can occur, for example, through typical measuring and liquid handling procedures used for making concentrates or solutions. Furthermore, variation can occur from inadvertent error in measuring procedures, differences in the manufacture, source, or purity of the ingredients employed to make the compositions or carry out the methods, and the like.

It will also be understood that when an element, such as a layer, region, or substrate is referred to as being "on" or "over" another element, it can be directly on the other element or intervening elements can also be present. In contrast, when an element is referred to as being "directly on" or "directly over" another element, there are no intervening elements present, and the element is in contact with another element.

Figure 2:
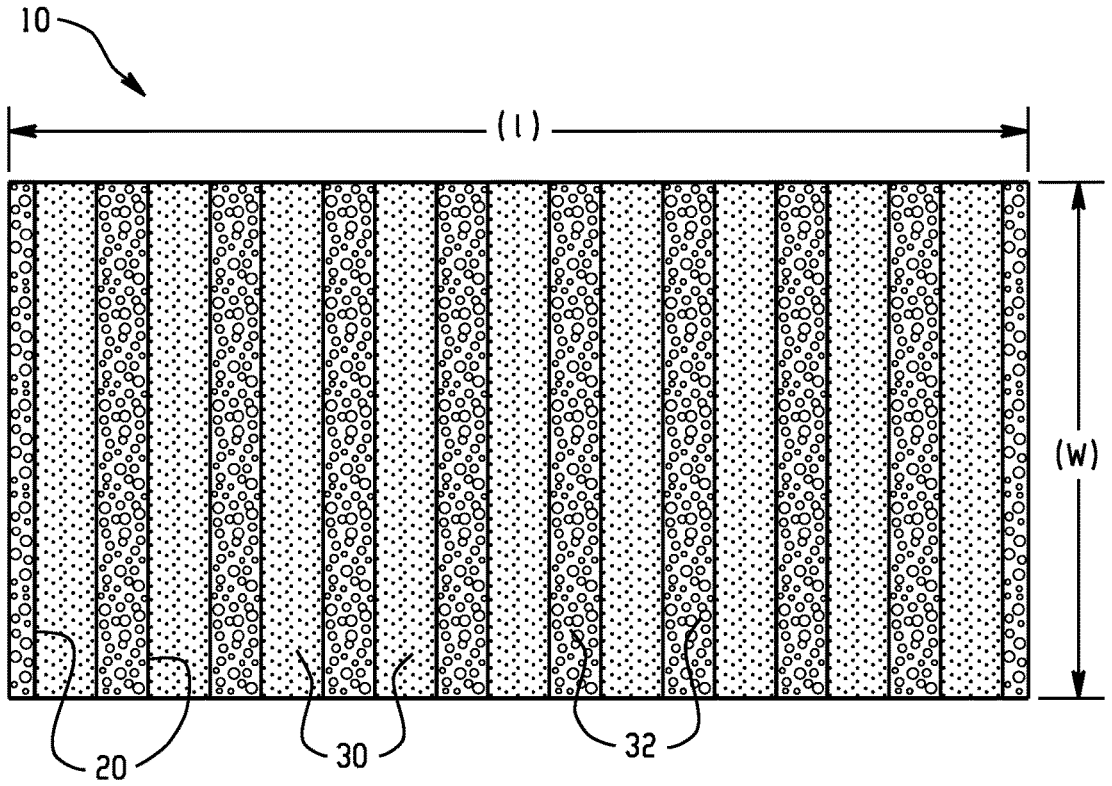
FIG. 2 illustrates top-down view of the mattress assembly of FIG. 1 taken along lines 2-2 in accordance with an embodiment of the present disclosure.

Referring now to FIG. 1, there is depicted a cross-sectional view of a mattress assembly including a cover layer 12, a topper layer 14 representative and exemplary of the at least one layer according to the present disclosure underlying the cover layer 12, and a mattress body 16 underlying the topper layer 14. FIG. 2 illustrates a top-down view of the mattress assembly taken along lines 2-2 of FIG. 1.

The illustrated topper layer 14 overlies the mattress body 16 and can be formed of foam 32. The topper layer 14 is generally parallelpiped-shaped having a length (L) dimension and a width (W) dimension that can be configured to approximate the length and width dimension of the mattress body 16. The illustrated topper layer 14 generally has a thickness equal to or less than 6 inches in one or more embodiments, a thickness equal to or less than 5 inches in other embodiments, or a thickness equal to or less than 4 inches in still other embodiments. In other embodiments, the thickness is greater than or equal 1 inch.

The topper layer 14 includes a plurality of channels 20 extending from one side of the layer to the other side. In one or more embodiments, the channels 20 are uniformly spaced apart within a selected surface and parallel to one another extending transversely from one side to another side of the width dimension (W) as shown. In one or more other embodiments, the channels 20 can longitudinally extend from one side to another side of the length dimension (not shown) and/or are non-uniformly spaced apart and/or are not parallel to one another.

Each of the channels 20 has a depth that is a fraction of a total thickness of the topper layer 14. In one or more embodiments, the depth of the channels is about 90% or less than the thickness of the topper layer 14. In one or more other embodiments, the depth of the channels is about 80% or less than the thickness of the topper layer 14, and in still one or more embodiments, the depth of the channels is about 70% or less than the thickness of the topper layer 14. In one or more embodiments, each of the channels 20 can have the same depth or have different depths depending on the intended application. In one or more embodiments, different depths can be employed to provide zoning. Similarly, the channels can be selectively located to provide zoning to correspond to the head region, the lumbar region, and/or the leg and foot region of the mattress assembly 10.

Disposed within each of the channels 20 is an encapsulated bulk phase change material 30, i.e., a phase change material or mixture of phase change materials sealing disposed within a preformed capsulate. Although the encapsulated bulk phase change material 30 is shown spanning the entire channel 20, it should be apparent that the encapsulated bulk phase change material 30 can be configured to span a portion thereof. Advantageously, the encapsulated bulk phase change material 30 provides extended cooling as needed to an end user of the mattress assembly 10. As shown, each of the encapsulated bulk phase change material 30 provided within a given channel is tubular shaped and is seated on a bottom surface 34 of the respective channel 20. The encapsulated bulk phase change material 30 can have a dimension that is a fraction of the depth of the channel 20 such that an optional space 33 is provided above the encapsulated bulk phase change material 30 relative to the uppermost surface 36 of the topper layer 14 as shown and/or can completed fill a respective channel 20. In one or more embodiments, the encapsulated bulk phase change material 30 in channels 20 having different depths (not shown), so that the encapsulated bulk phase change material can be activated at different times, e.g., the encapsulated bulk phase change material 30 closest to the sleeping surface (i.e., closest to the cover layer 12) will activate earlier than the encapsulated bulk phase change material farther away from the sleeping surface.

The cover layer 12 is the uppermost layer and has a planar top surface adapted to substantially face a user resting on the mattress assembly and overlays the topper layer. The cover layer 12 generally has length and width dimensions sufficient to support a reclining body of the user. The cover layer 12 is not intended to be limited and can be formed of foam, fibers, mixtures thereof, or the like. In one or more embodiments, the cover layer can be formed from viscoelastic foam or non-viscoelastic foam depending on the intended application. The foam itself can be of any open or closed cell foam material including without limitation, latex foams, natural latex foams, polyurethane foams, combinations thereof, and the like. The thickness of the cover layer is generally within a range of about 0.5 to 2 inches in some embodiments, and less than 1 inch in other embodiments so as to provide the extended cooling benefits of the underlying layer including the channels and the encapsulated bulk phase change material or materials. The density of the cover layer 12 can be within a range of 1 to 8 $lb/ft^3$ in some embodiments, and 2 to 4 $lb/ft^3$ in other embodiments. The hardness is within a range of about 7 to 28 pounds-force in some embodiments, and less than 15 pounds-force in other embodiments. In one or more embodiments, the cover layer can be configured as a quilt panel or a convoluted foam.

The cover layer 12 and the topper layer 14 collectively overlie the mattress body 16. The mattress body 16 is not intended to be limited and can include one or more layers including foam layers, fiber layers, coil layers, air bladders, various combinations thereof, and the like. Generally, the mattress body 16 can have a thickness be greater than 4 inches to less than 12 inches although greater or lesser thicknesses can be used. Suitable foam layers include, without limitation, synthetic and natural latex, polyurethane, polyethylene, polypropylene, and the like. Optionally, in some embodiments, one or more of the foam layers may be pre-stressed such as is disclosed in U.S. Pat. No. 7,690,096, incorporated herein by reference in its entirety. The coil layers generally include coil springs are not intended to be limited to any specific type or shape. The coil springs can be single stranded or multi-stranded, pocketed or not pocketed, asymmetric or symmetric, and the like. It will be appreciated that the pocket coils may be manufactured in single pocket coils or strings of pocket coils, either of which may be suitably employed with the mattresses described herein. The attachment between coil springs may be any suitable attachment. For example, pocket coils are commonly attached to one another using hot-melt adhesive applied to abutting surfaces during construction.

The mattress assembly 10 can further include a side rail assembly (not shown) about all or a portion of the perimeter of at least by the mattress body 16 and optionally the cover and topper layers, 12,14, respectively. In some embodiments, the cover layer and the topper layer overlay the mattress body and the side rail assembly. The side rails that define the assembly may be attached to or placed adjacent to at least a portion of the perimeter of the mattress body 16, and may include metal springs, spring coils, encased spring coils, foam, latex, natural latex, latex w/gel, gel, viscoelastic gel, fluid bladders, or a combination thereof, in one or more layers. The side rails may be placed on one or more of the sides of the mattress body 16, e.g., on all four sides, on opposing sides, on three adjacent sides, or only on one side. In certain embodiments, the side rails may comprise edge supports with a firmness greater than that provided by the mattress body 16. The side rails may be fastened to the stacked mattress layers via adhesives, thermal bonding, or mechanical fasteners.

For ease in manufacturing the mattress assembly, the side rail assembly may be assembled in linear sections that are joined to one another to form the perimeter about the mattress layers. Alternatively, the ends may be mitered or have some other shape, e.g., lock and key type shape.

The presence of the encapsulated phase change material 30 within the channel 20 and the optional space 33 has unexpectedly been found to further improve heat absorption, heat flux and heat index properties. As used herein, the term "heat absorption" generally refers to the total cumulative heat transferred from an end user into an underlying layer, e.g., heat transfer from a human body reclining on the mattress assembly 10 into the topper layer 14; the term "heat index" generally refers to what the temperature feels like to the end user and includes the effects of both temperature and humidity; and the term "heat flux" or "Heat Flux Density" or "Heat Flow rate intensity" is the flow of energy per unit area per unit of time. The energy per unit area is typically given in Watts per meter squared ($W/m^2$). This energy has a direction and a magnitude so it is a vector quantity. This measurement shows how the amount of heat passing through a certain surface, e.g., energy passing through the cover layer 12 into the topper layer 14 changes over time.

In one or more embodiments, the space 32 is generally greater than 0 to less than about 95 percent of the channel depth, i.e., the encapsulated bulk phase change material is greater than 0 to about 25 percent of the channel depth (D). In one or more other embodiments, the space 32 is greater than 0 to less than about 50 percent of the channel depth, and in still one or more other embodiments, the space 32 is less than 25 percent of the channel depth.

Figure 3:
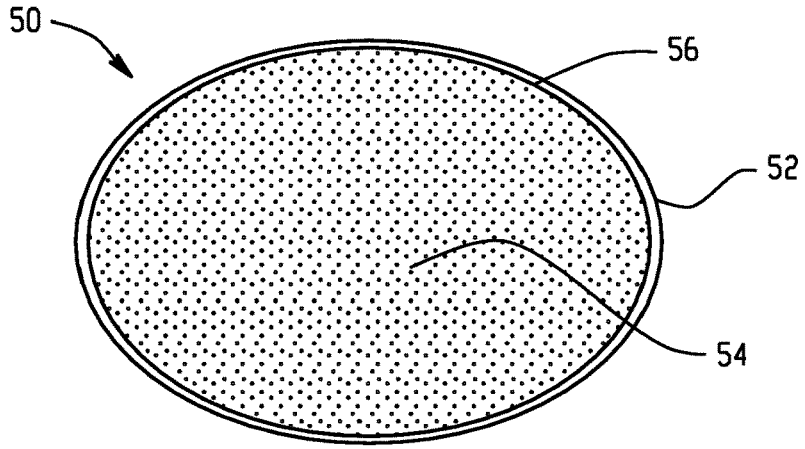
FIG. 3 illustrates a cross sectional view of an exemplary encapsulated bulk phase change capsulate in accordance with an embodiment of the present disclosure.

FIG. 3 provides a cross sectional view of an exemplary encapsulated bulk phase change material 50. The encapsulated bulk phase change material 50 includes a flexible capsulate 52 formed of materials selected to have mechanical properties sufficient to accommodate volume changes that may occur during phase change transitions, withstand the rigors of product durability, and maintain thermal and tactile comfort during use in a variety of end use environments. Disposed within the capsulate 52, is a phase change material 54 or a mixture of phase change materials. In one or more embodiments, the encapsulated bulk phase change material(s) 50 further may include a permeable material 56 such as an open cell foam disposed within the capsulate, wherein the permeable material can be infused with the bulk phase change material or materials and inserted into the capsulate prior to sealing of the capsulate.

Phase change materials are relatively inexpensive whereas the cost to manufacture prior art microencapsulated phase change materials are relatively high since the encapsulation material has a high surface area relative to the amount of phase change material contained within each cell. In contrast, the encapsulated bulk amounts of a phase change material of the present disclosure provide a markedly higher volume of phase change material(s) within the capsulate material that lowers the surface area of the capsulate material relative to the amount of phase change material, thereby providing a significant cost reduction. In this manner, instead of milligrams to grams of phase change material within a given layer as is currently done in the prior art, the present invention advantageously provides the capability of utilizing hundreds of grams or pounds of phase change material within a given layer as may be desired for different applications. The increased amount of phase change material within the plurality of channels in the layer can be configured to extend the effective solid to liquid or liquid to solid transition time of the phase change material throughout an entire sleep cycle of 8 hours or more, which is unlike prior art microencapsulated phase change layers that generally provide an effective transition time of a few minutes to about 30 minutes.

Although a tubular shape is generally shown in FIGS. 1 and 2, the encapsulated bulk phase change material 50 is not intended to be limited to any particular geometric shape. In one or more embodiments, the encapsulated bulk phase change material can be composed of a single sealed cell. In one or more other embodiments, the encapsulated bulk phase change material can be formed of multiple interconnected fluidly connected to one another, and in one or more other embodiments, the encapsulated bulk phase change material can be formed of multiple discrete cells. In the case of a single sealed cell, interconnected cells, or multiple individual discrete cells, the cellular volumes are generally greater than 1 $cm^3$.

The permeable material 56 can be saturated with the phase change material or materials while in a liquid state, inserted into an opening of the capsulate material, and then sealed. This would help the layer keep its shape when the phase change material or materials changes to its liquid state. Without the addition of a permeable material such as an open cell foam when the phase change material or materials changes state to a liquid it would naturally migrate to the side away the pressure of a reclining body. The addition of the foam will insure there is a level of support being provided by the layer even after the phase change material or materials transitions to a liquid state.

In one or more embodiments, the amount of phase change material in the encapsulated bulk phase change material 30 is at least 100 grams per square foot of surface area, greater than about 400 grams per square foot in other embodiments, and greater than about 800 grams per square foot in still other embodiments.

The capsulate material 52 can be formed of a flexible material such as polyethylene or the like as the capsulate material, which can be filled with the phase change material 54 or a mixture of phase change materials, and optionally foam or other permeable material 56. Still further, additional material(s) such as flame retardants, antibacterial agents, thermally conductive components, and/or the like can be included within the capsulate 52. In one or more embodiments, the capsulate material 52 further includes a thermally conductive material.

The particular configuration in terms of cell shape, cell size, cell spatial volume, spacing between cells, fluid connection between linked cells, and the like of the encapsulated bulk phase change material 50 is not intended to be limited. Generally, as it relates to the size, spatial volume, and shape of the cell, the amount of phase change material contained therein is effective to provide a phase transition time to the end user of at least about 30 minutes or greater. In contrast, prior art microencapsulated phase change materials for bedding applications are generally on the order of a few grams or micrograms per square foot.

The capsulate 52 can be formed from two-ply sheets of a resilient and flexible material such as polyethylene and is selected to be compatible with the intended phase change material(s) to be used. As used herein, the term "two-ply" generally refers to two separate sheets, first and second sheets, that are coupled to one another to form the capsulate sheet as described in greater detail below. The individual sheets themselves that define the two-ply capsulate sheet configuration can be formed from a single layer or multiple layers as may be desired for desired strength and resiliency.

Phase change materials that can be incorporated in the preformed capsulate in accordance with various embodiments of the disclosure include a variety of organic and inorganic substances including paraffins; bio-phase change materials derived from acids, alcohols, amines, esters, and the like; salt hydrates; and the like. The particular phase change material or mixtures thereof are not intended to be limited.

Exemplary phase change materials include hydrocarbons (e.g., straight chain alkanes or paraffinic hydrocarbons, branched-chain alkanes, unsaturated hydrocarbons, halogenated hydrocarbons, and alicyclic hydrocarbons), bio-phase change materials derived from fatty acids and their derivatives, (e.g., alcohols, amines, esters, and the like), hydrated salts (e.g., calcium chloride hexahydrate, calcium bromide hexahydrate, magnesium nitrate hexahydrate, lithium nitrate trihydrate, potassium fluoride tetrahydrate, ammonium alum, magnesium chloride hexahydrate, sodium carbonate decahydrate, disodium phosphate dodecahydrate, sodium sulfate decahydrate, and sodium acetate trihydrate), waxes, oils, water, fatty acids, fatty acid esters, dibasic acids, dibasic esters, 1-halides, primary alcohols, aromatic compounds, clathrates, semi-clathrates, gas clathrates, anhydrides (e.g., stearic anhydride), ethylene carbonate, polyhydric alcohols (e.g., 2,2-dimethyl-1,3-propanediol, 2-hydroxymethyl-2-methyl-1,3-propanediol, ethylene glycol, polyethylene glycol, pentaerythritol, dipentaerythritol, pentaglycerine, tetramethylol ethane, neopentyl glycol, tetramethylol propane, 2-amino-2-methyl-1,3-propanediol, monoaminopentaerythritol, diaminopentaerythritol, and tris (hydroxymethyl)acetic acid), polymers (e.g., polyethylene, polyethylene glycol, polyethylene oxide, polypropylene, polypropylene glycol, polytetramethylene glycol, polypropylene malonate, polyneopentyl glycol sebacate, polypentane glutarate, polyvinyl myristate, polyvinyl stearate, polyvinyl laurate, polyhexadecyl methacrylate, polyoctadecyl methacrylate, polyesters produced by polycondensation of glycols (or their derivatives) with diacids (or their derivatives), and copolymers, such as polyacrylate or poly(meth) acrylate with alkyl hydrocarbon side chain or with polyethylene glycol side chain and copolymers comprising polyethylene, polyethylene glycol, polyethylene oxide, polypropylene, polypropylene glycol, or polytetramethylene glycol), metals, and mixtures thereof. Bio-phase change materials have high latent heat, small volume change for phase transition, sharp well-defined melting temperature and reproducible behavior.

The selection of a phase change material will typically be dependent upon a desired transition temperature. For example, a phase change material having a transition temperature slightly above room temperature but below skin temperature may be desirable for mattress applications to maintain a comfortable temperature for a user.

A suitable phase change material can have a phase transition temperature within a range of about 22° to about 36° C. In one or more other embodiments, the transition temperature within a range of about 25° C. to about 30° C. With regard to paraffin phase change materials, the number of carbon atoms of a paraffinic hydrocarbon typically correlates with its melting point. For example, n-octacosane, which contains twenty-eight straight chain carbon atoms per molecule, has a melting point of 61.4° C. whereas n-tridecane, which contains thirteen straight chain carbon atoms per molecule, has a melting point of −5.5° C. According to an embodiment of the disclosure, n-octadecane, which contains eighteen straight chain carbon atoms per molecule and has a melting point of 28.2° C., is particularly desirable for mattress applications. Additionally, coconut fats and oils can be suitable used as a phase change material for mattress applications, which can be selected to have a melting temperature of 19 to 34° C.

Other useful phase change materials include polymeric phase change materials having transition temperatures within a range of about 22° to about 36° C. in one or more embodiments, and a transition temperature within a range of about 26° to about 30° C. in other embodiments. A polymeric phase change material may comprise a polymer (or mixture of polymers) having a variety of chain structures that include one or more types of monomer units. Polymeric phase change materials may include linear polymers, branched polymers (e.g., star branched polymers, comb branched polymers, or dendritic branched polymers), or mixtures thereof. A polymeric phase change material may comprise a homopolymer, a copolymer (e.g., terpolymer, statistical copolymer, random copolymer, alternating copolymer, periodic copolymer, block copolymer, radial copolymer, or graft copolymer), or a mixture thereof. As one of ordinary skill in the art will understand, the reactivity and functionality of a polymer may be altered by addition of a functional group such as, for example, amine, amide, carboxyl, hydroxyl, ester, ether, epoxide, anhydride, isocyanate, silane, ketone, and aldehyde. Also, a polymer comprising a polymeric phase change material may be capable of crosslinking, entanglement, or hydrogen bonding to increase its toughness or its resistance to heat, moisture, or chemicals.

According to some embodiments of the disclosure, a polymeric phase change material may be desirable as a result of having a higher molecular weight, larger molecular size, or higher viscosity relative to non-polymeric phase change materials (e.g., paraffinic hydrocarbons). In addition to providing thermal regulating properties, a polymeric phase change material may provide improved mechanical properties (e.g., ductility, tensile strength, and hardness).

For example, polyethylene glycols may be used as the phase change material in some embodiments of the disclosure. The number average molecular weight of a polyethylene glycol typically correlates with its melting point. For instance, a polyethylene glycol having a number average molecular weight range of 570 to 630 (e.g., Carbowax 600) will have a melting point of 20° to 25° C., making it desirable for mattress applications. Further desirable phase change materials include polyesters having a melting point in the range of 22° to 40° C. that may be formed, for example, by polycondensation of glycols (or their derivatives) with diacids (or their derivatives).

According to some embodiments of the disclosure, a polymeric phase change material having a desired transition temperature may be formed by reacting a phase change material (e.g., an exemplary phase change material discussed above) with a polymer (or mixture of polymers). Thus, for example, n-octadecylic acid (i.e., stearic acid) may be reacted or esterified with polyvinyl alcohol to yield polyvinyl stearate, or dodecanoic acid (i.e., lauric acid) may be reacted or esterified with polyvinyl alcohol to yield polyvinyl laurate. Various combinations of phase change materials (e.g., phase change materials with one or more functional groups such as amine, carboxyl, hydroxyl, epoxy, silane, sulfuric, and so forth) and polymers may be reacted to yield polymeric phase change materials having desired transition temperatures.

Table 1 provides a list of exemplary commercially available phase change materials and the corresponding metal point (Tm) suitable for use in mattress applications described herein.

TABLE 1

| Material | Supplier | Type | Form | Melting point, Tm |
|---|---|---|---|---|
| 0500- Q28 BioPCM | Phase Change Energy Solutions | Functionalized BioPCM | Bulk, Macro-encapsulated | 28° C. (82° F.) |
| PureTemp 28 | PureTemp LLC | Organic | Bulk | 28° C. (82° F.) |
| RT27 | Rubitherm GmbH | Organic | Bulk | 28° C. (82° F.) |
| Climsel C28 | Climator | Inorganic | Bulk | 28° C. (82° F.) |
| RT 30 | Rubitherm GmbH | Organic | Bulk | 28° C. (82° F.) |
| RT 28 HC | Rubitherm GmbH | Organic | Bulk | 28° C. (82° F.) |
| A28 | PlusICE | Organic | Bulk | 28° C. (82° F.) |
| MPCM 28 | Microtek | Organic | Micro-encapsulated | 28° C. (82° F.) |
| MPCM 28D | Microtek | Organic | Micro-encapsulated | 28° C. (82° F.) |
| Latest 29 T | TEAP | Inorganic | Bulk | 28° C. (82° F.) |
| 0500- Q29 BioPCM | Phase Change Energy Solutions | Functionalized BioPCM | Bulk, Macro-encapsulated | 29° C. (84° F.) |
| 29 C° Infinite R | Insolcorp | Inorganic | Macro-encapsulated | 29° C. (84° F.) |
| savE HS 29 | Pluss | Inorganic | Bulk | 29° C. (84° F.) |
| savE OM 29 | Pluss | Organic | Bulk | 29° C. (84° F.) |
| savE FS 29 | Pluss | Organic | Bulk | 29° C. (84° F.) |
| PureTemp 29 | PureTemp LLC | Organic | Bulk | 29° C. (84° F.) |
| TH 29 | TEAP | Inorganic | Bulk | 29° C. (84° F.) |
| A29 | PlusICE | Organic | Bulk | 29° C. (84° F.) |
| PCM-HS29P | SAVENRG | Inorganic | Bulk | 29° C. (84° F.) |
| CrodaTherm ™ 29 | Croda International Plc | Organic | Bulk | 29° C. (84° F.) |
| 0500- Q30 BioPCM | Phase Change Energy Solutions | Functionalized BioPCM | Bulk, Macro-encapsulated | 30° C. (86° F.) |
| S30 | PlusICE | Inorganic | Bulk | 30° C. (86° F.) |
| savE OM 30 | Pluss | Organic | Bulk | 31° C. (88° F.) |
| savE FS 30 | Pluss | Organic | Bulk | 31° C. (88° F.) |
| RT 31 | Rubitherm GmbH | Organic | Bulk | 31° C. (88° F.) |
| 0500- Q32 BioPCM | Phase Change Energy Solutions | Functionalized BioPCM | Bulk, Macro-encapsulated | 32° C. (90° F.) |
| savE OM 32 | Pluss | Organic | Bulk | 32° C. (90° F.) |
| Climsel C32 | Climator | Inorganic | Bulk | 32° C. (90° F.) |
| S32 | PlusICE | Inorganic | Bulk | 32° C. (90° F.) |
| A32 | PlusICE | Organic | Bulk | 32° C. (90° F.) |
| PCM-OM32P | SAVENRG | Organic | Bulk | 32° C. (90° F.) |

Also, the phase change material according to one or more embodiments can have a latent heat that is at least about 40 Joules/gram (J/g), at least about 50 J/g in other embodiments, and at least about 60 J/g in still other embodiments. As used herein, the term "latent heat" can refer to an amount of heat absorbed or released by a substance (or mixture of substances) as it undergoes a transition between two states. Thermal energy can be stored or removed from a phase change material, and the phase change material typically can be effectively recharged by a source of heat or cold. By selecting an appropriate phase change material, a multi-component fiber can be designed for use in any one of numerous products.

The phase change material can include a mixture of two or more substances (e.g., two or more of the exemplary phase change materials discussed above). By selecting two or more different substances (e.g., two different paraffinic hydrocarbons) and forming a mixture thereof, a temperature stabilizing range can be adjusted over a wide range to extend the cooling effect over a longer period of time. For example, octadecane can be used as the primary phase change material to which a small amount of phase change material(s) having a lower carbon content (e.g., $C_{16}$, $C_{17}$) can be used to lower the melting point, which can make the mixture less hard at room temperature. According to some embodiments of invention, the mixture of two or more different substances may exhibit two or more distinct transition temperatures or a single modified transition temperature.

During manufacture of the layer, the phase change material in the raw form may be provided as a solid in a variety of forms (e.g., bulk form, powders, pellets, granules, flakes, microencapsulates, and so forth) or as a liquid in a variety of forms (e.g., molten form, dissolved in a solvent, and so forth).

As noted above, the phase change material(s) is provided within the capsulate, which generally consists of a flexible pouch partially filled with or without air. In one or more embodiments, the phase change material can be injected directly into a cell and subsequently sealed using a hardener or a sealing adhesive. In other embodiments, recesses are formed in a carrier sheet and subsequently filled with the desired phase change material. A cover sheet is the coupled applied to the carrier sheet. The coupling can be provided with an applied adhesive or can be thermally fused. In one or more embodiments, the phase change material can be maintained above its melting temperature during the injection.

Figure 4:
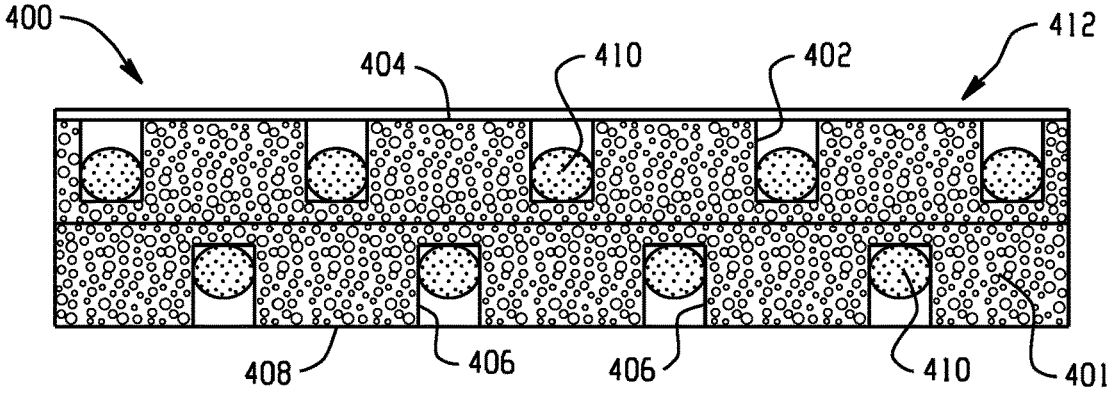
FIG. 4 illustrates a cross-sectional view of a mattress assembly including at least one layer including channels and an encapsulated bulk phase change material within the channels in accordance with an embodiment of the present disclosure.

Turning now to FIG. 4, a cross-sectional view of a topper layer 400 representative of the at least one layer including a plurality of channels and a bulk phase change material(s) disposed in the channels in accordance with the present disclosure is depicted. A cover layer 412 overlies the topper layer 400, which overlay a mattress body (not shown) in the manner as previously described. The illustrated topper layer 400 is formed of foam 401 and includes a plurality of channels 402 formed in a top surface 404 and a plurality of channels 406 formed in a bottom surface 408. The channels 402 and 406 are depicted in a staggered relationship, i.e., zipper-like format. An encapsulated bulk phase change material 410 is provided in the channels 402 and 406 such that the encapsulated bulk phase change materials 410 within channels 402 relative to channels 406 are at different depths relative to the sleeping surface, which is generally indicated by cover layer 412. The foam 401 defining the topper layer 400 is an insulating material and during use, slowly develops a temperature gradient, wherein the portion of foam closest to sleeping surface and the end user is warmest. Consequently, the encapsulated bulk phase change material 410 disposed within channels 402 in closer proximity to the sleeping surface will activate earlier than the encapsulated bulk phase change material 410 disposed within channels 406, which is farther away from the sleeping surface. By increasing or decreasing the distance within the foam 401 between the opposing channels 402, 406 and the respective enclosed bulk phase change materials 410 therein, phase change activation of the encapsulated bulk phase change material 410 disposed within channels 406 can be selectively tuned to modify the temperature gradient so as to affect the heat flow over a longer period of time than that previously possible. Moreover, it should be apparent that the encapsulated bulk phase change material can be the same or different within the different channels.

Figure 5:
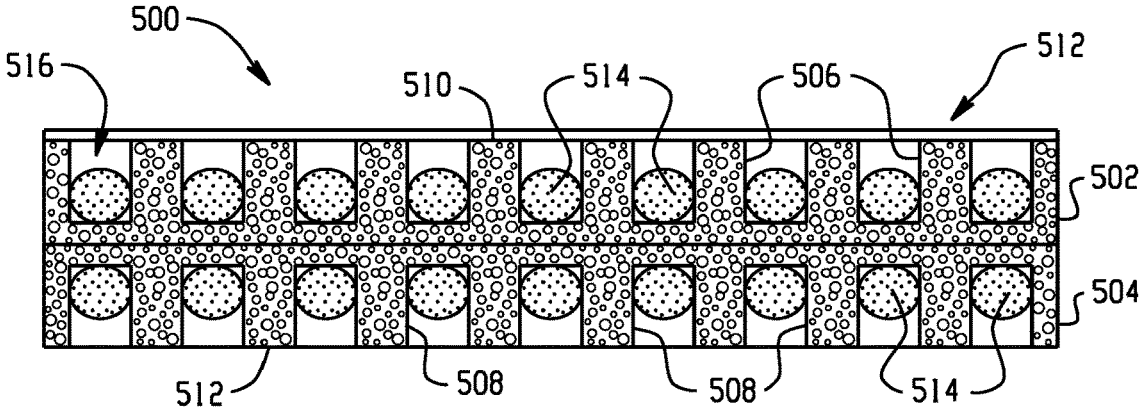
FIG. 5 illustrates a cross-sectional view of a mattress assembly including at least one layer including channels and an encapsulated bulk phase change material within the channels in accordance with an embodiment of the present disclosure.

Turning now to FIG. 5, a cross-sectional view of a topper layer 500 representative of the at least one layer including a plurality of channels and a bulk phase change material(s) in accordance with the present disclosure is depicted. A cover layer 512 is shown to indicate the orientation within a mattress assembly, wherein the cover layer is the uppermost layer of the mattress assembly and has a planar top surface adapted to substantially face a user resting on the mattress assembly.

As discussed above in relation to FIG. 4, channel cuts can be made in the top and bottom surfaces of the topper layer 400. However, current manufacturing processes for providing the channel cuts on opposing sides of a single foam layer are relatively expensive. In the embodiment shown in FIG. 5, the topper layer 500 is defined by two foam layers 502, 504, wherein each layer 502 and 504 includes a plurality of channels 506, 508, respectively, formed in a selected surface and coupled to one another, e.g., adhesively attached, to collectively provide the topper layer 500 with a top surface 510 including a plurality top channels 506 and a bottom surface 512 including a plurality of bottom channels 508 in a staggered relationship with a plurality of bottom channels in layer 504 similar to the topper layer in FIG. 4. An encapsulated bulk phase change material 514 is provided in each of the channels 506 and 508 such that the encapsulated bulk phase change materials 514 in layer 502 are at different depths relative to the sleeping surface compared to the encapsulated bulk phase change material in layer 504. The encapsulated bulk phase change material 514 can partially fill a portion of each channel 506, 508 so as to provide a space 516 for additional ventilation as is generally shown and/or fill the respective channel 506, 508 in its entirety. The manufacture of channel cuts in one selected surface as opposed to both surfaces is markedly less expensive based on current manufacturing processes.

Figure 6:
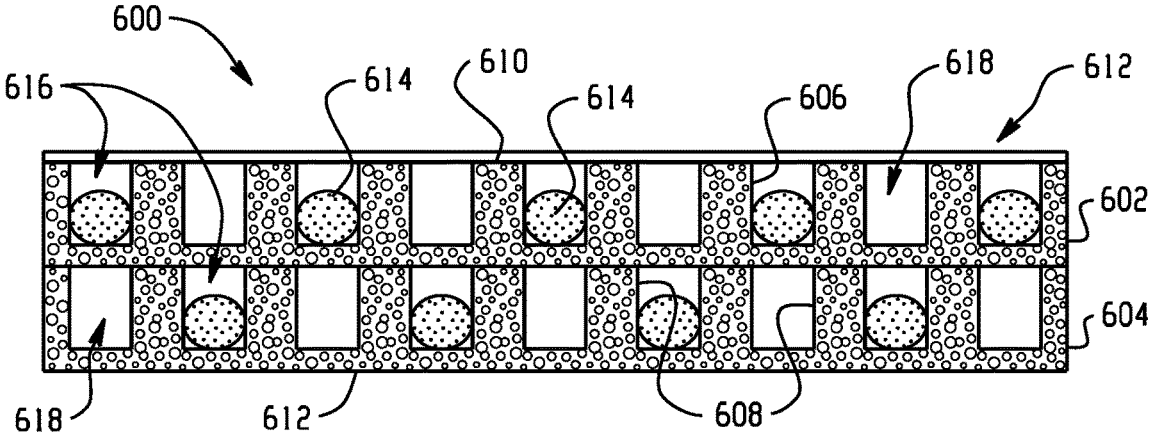
FIG. 6 illustrates a cross-sectional view of a mattress assembly including at least one layer including channels and an encapsulated bulk phase change material within the channels in accordance with an embodiment of the present disclosure.

Turning now to FIG. 6, a cross-sectional view of a topper layer 600 representative of the at least one layer including a plurality of channels and a bulk phase change material(s) in accordance with the present disclosure is depicted. A cover layer 612 is shown to indicate the orientation within a mattress assembly, wherein the cover layer is the uppermost layer of the mattress assembly and has a planar top surface adapted to substantially face a user resting on the mattress assembly.

In this embodiment, the topper layer 600 is constructed with channels 606 and 608 each formed in a selected surface of foam layers 602 and 604, respectively. The foam layers 602, 604 are coupled to one another such as by use of an adhesive to collectively provide the topper layer 600 with a top surface 610 including channels 606, internal channels 608, and a bottom planar surface 612 free of channel openings. Some of the channels 606 and 608 are filled with an encapsulated bulk phase change material 614 to provide a staggered relationship. The encapsulated bulk phase change material 614 can partially fill a portion of each channel 606, 608 where indicated so as to provide a space 616 for additional ventilation as is generally shown and/or fill the respective channel 606, 608 in its entirety. Additional ventilation spaces 618 is provided from those channels 606, 608 selected not to receive the encapsulated bulk phase change material 614.

Figure 7:
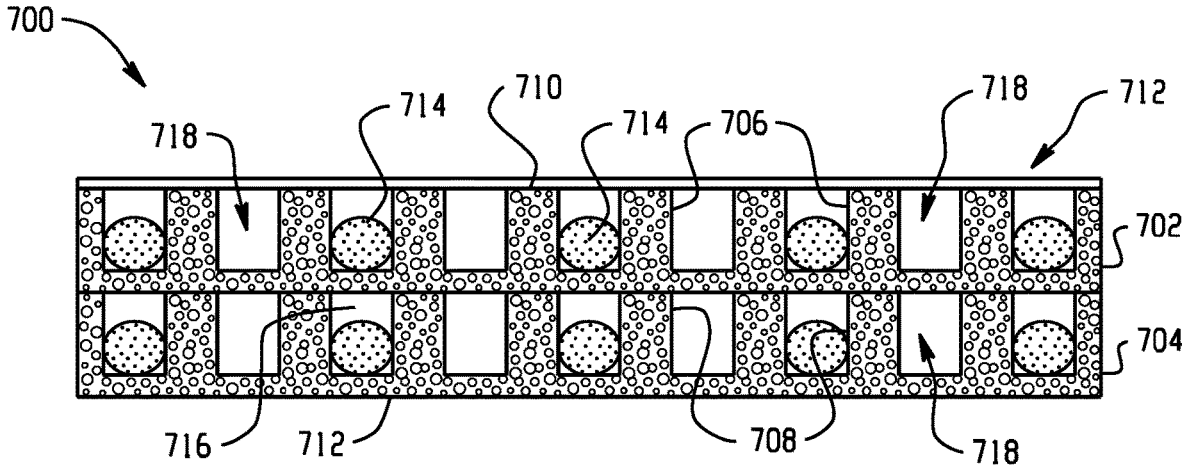
FIG. 7 illustrates a cross-sectional view of a mattress assembly including at least one layer including channels and an encapsulated bulk phase change material within the channels in accordance with an embodiment of the present disclosure.

Turning now to FIG. 7, a cross-sectional view of a topper layer 700 representative of the at least one layer including a plurality of channels and a bulk phase change material(s) in accordance with the present disclosure is depicted. A cover layer 712 is shown to indicate the orientation within a mattress assembly, wherein the cover layer is the uppermost layer of the mattress assembly and has a planar top surface adapted to substantially face a user resting on the mattress assembly.

In this embodiment, the topper layer 700 is constructed with channels 706 and 708 each formed in a selected surface of foam layers 702 and 704, respectively. The foam layers 702, 704 are coupled to one another such as by use of an adhesive to collectively provide the topper layer 700 with a top surface 710 including channels 706, internal channels 708, and a bottom planar surface 712 free of channel openings. Some of the channels 706 and 708 are provided with an encapsulated bulk phase change material 714. The channels 706, 708 provided with the encapsulated bulk phase change material are selected to be aligned relative to one another with some of the channels without the encapsulated bulk phase change material. As shown, the encapsulated bulk phase change material is provided in an alternating relationship. However, it should be apparent that different relationships can be provided. In some embodiments, providing the encapsulated bulk phase change material can be used to provide one or more zones corresponding to the head region, the lumbar region and/or the leg and foot region.

The encapsulated bulk phase change material 714 can partially fill a portion of each channel 706, 708, where indicated, so as to provide a space 716 for additional ventilation as is generally shown and/or fill the respective channel 706, 708 in its entirety. Additional ventilation spaces 718 can be provided from those channels 706, 708 selected not to receive the encapsulated bulk phase change material 714. This additional ventilation is optional and can be added if needed.

Figure 8:
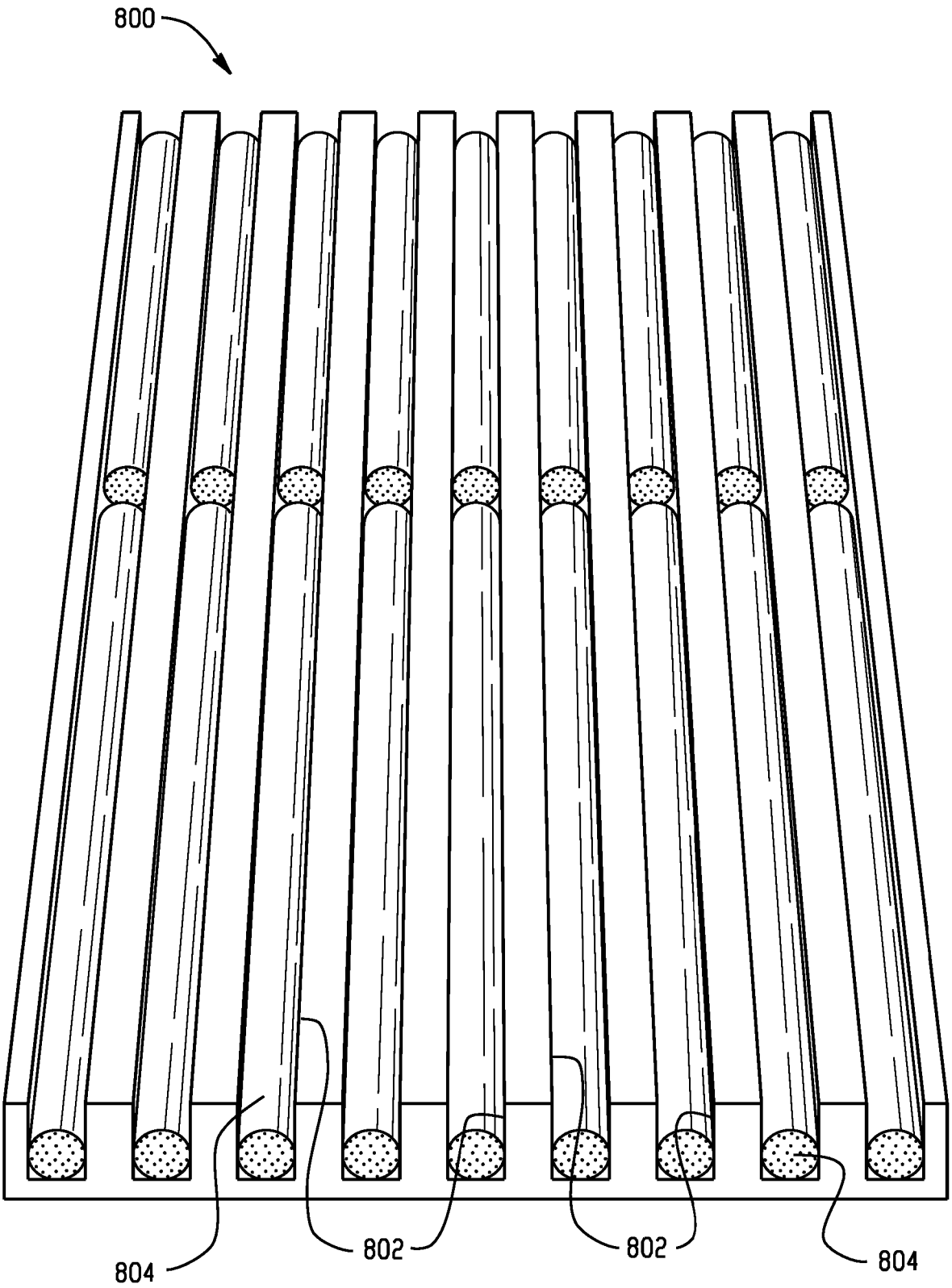
FIG. 8 pictorially illustrates a perspective top view of a topper layer for a mattress assembly including at least one layer including channels and an encapsulated bulk phase change material within the channels in accordance with an embodiment of the present disclosure.

Turning now to FIG. 8, there is pictorially depicted a perspective top view of a prototype topper layer 800 for a mattress assembly including channels and an encapsulated bulk phase change material within the channels in accordance with an embodiment of the present disclosure. As shown, the topper layer 800 includes a plurality of channels 802 and an encapsulated bulk phase change material 804 disposed within each channel. The encapsulated phase change material partially fills the channel so as to provide a space above when utilized in the mattress assembly. The encapsulated bulk phase change material 804 extends from one side to the other side of the width dimension. The illustrated topper layer 800 is dimensioned to simultaneously accommodate two end users and the encapsulated bulk phase change material is longitudinally bifurcated to provide selective cooling to each end user, i.e., there are two encapsulated bulk phase change material 804 provided in each channel and are generally have a spaced apart end to end relationship.

In one or more embodiments, the encapsulated bulk phase change material 804 would extend across the entire sleeping surface if the bed is designed for more than one sleeper.

Figure 9:
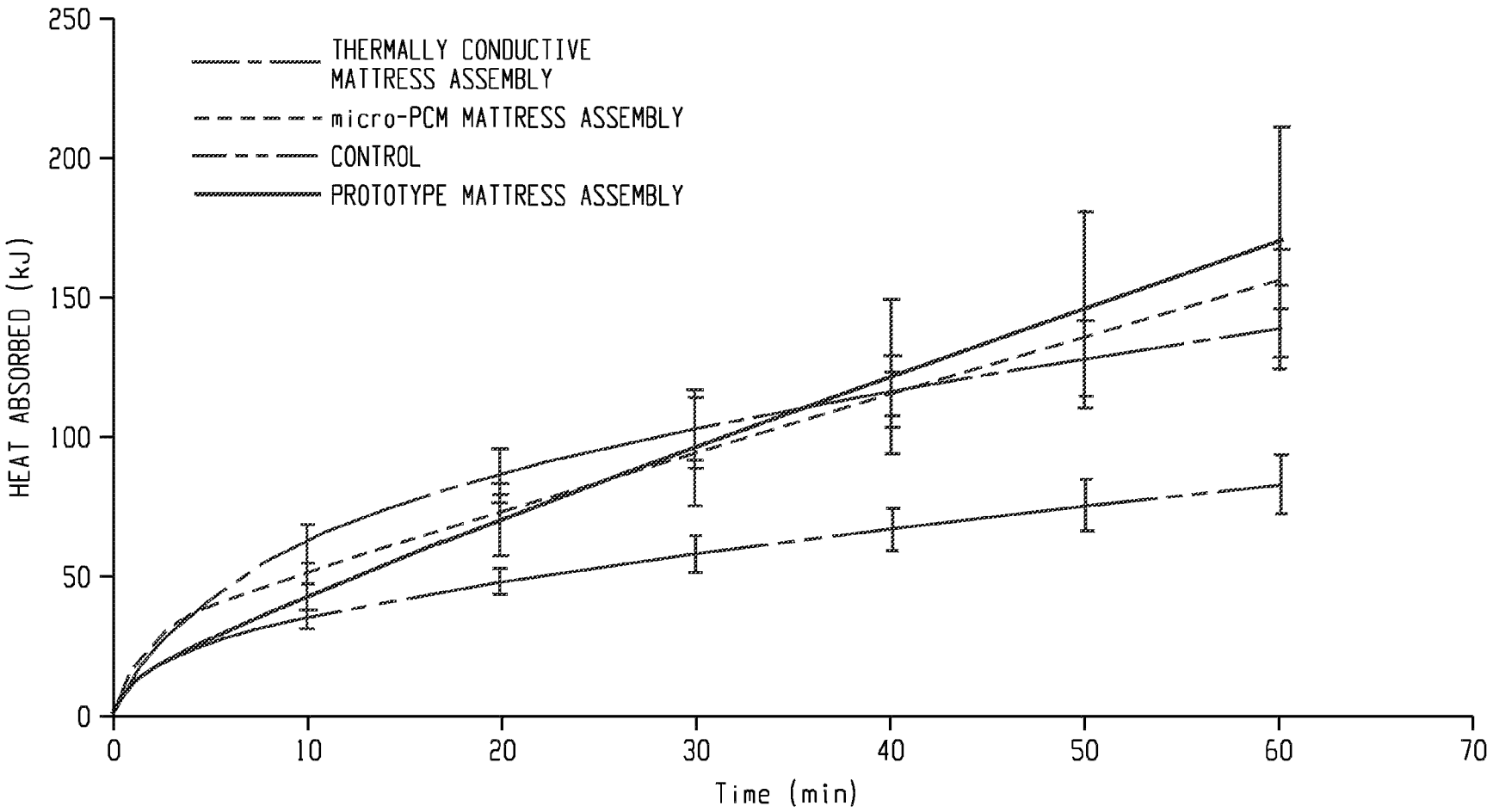
FIG. 9 graphically illustrates heat absorption as a function of time for various mattress assemblies compared to control mattress assemblies in accordance with an embodiment of the present disclosure.
Figure 10:
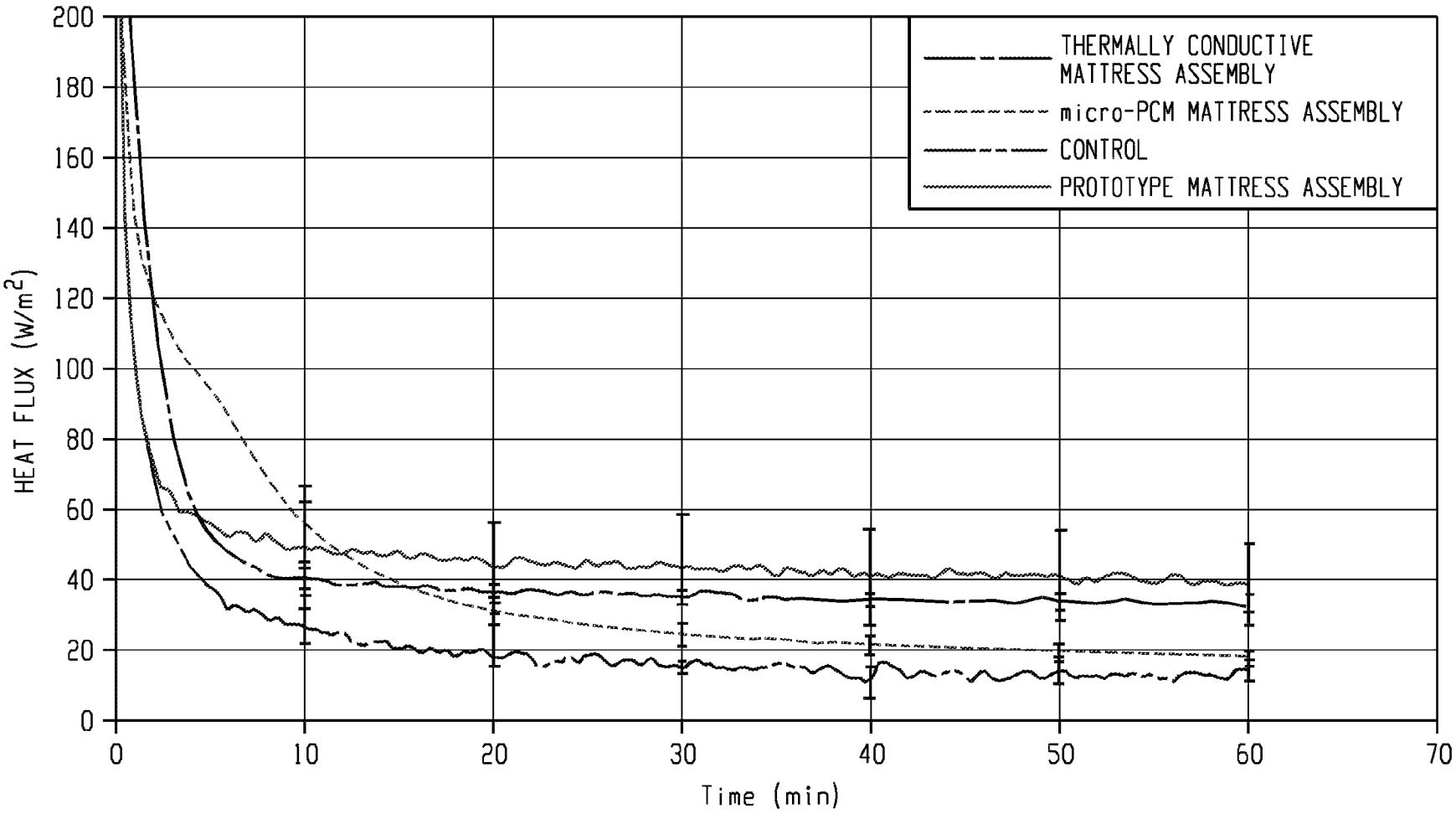
FIG. 10 graphically illustrates heat flux as a function of time for various mattress assemblies in accordance with an embodiment of the present disclosure compared to control mattress assemblies.
Figure 11:
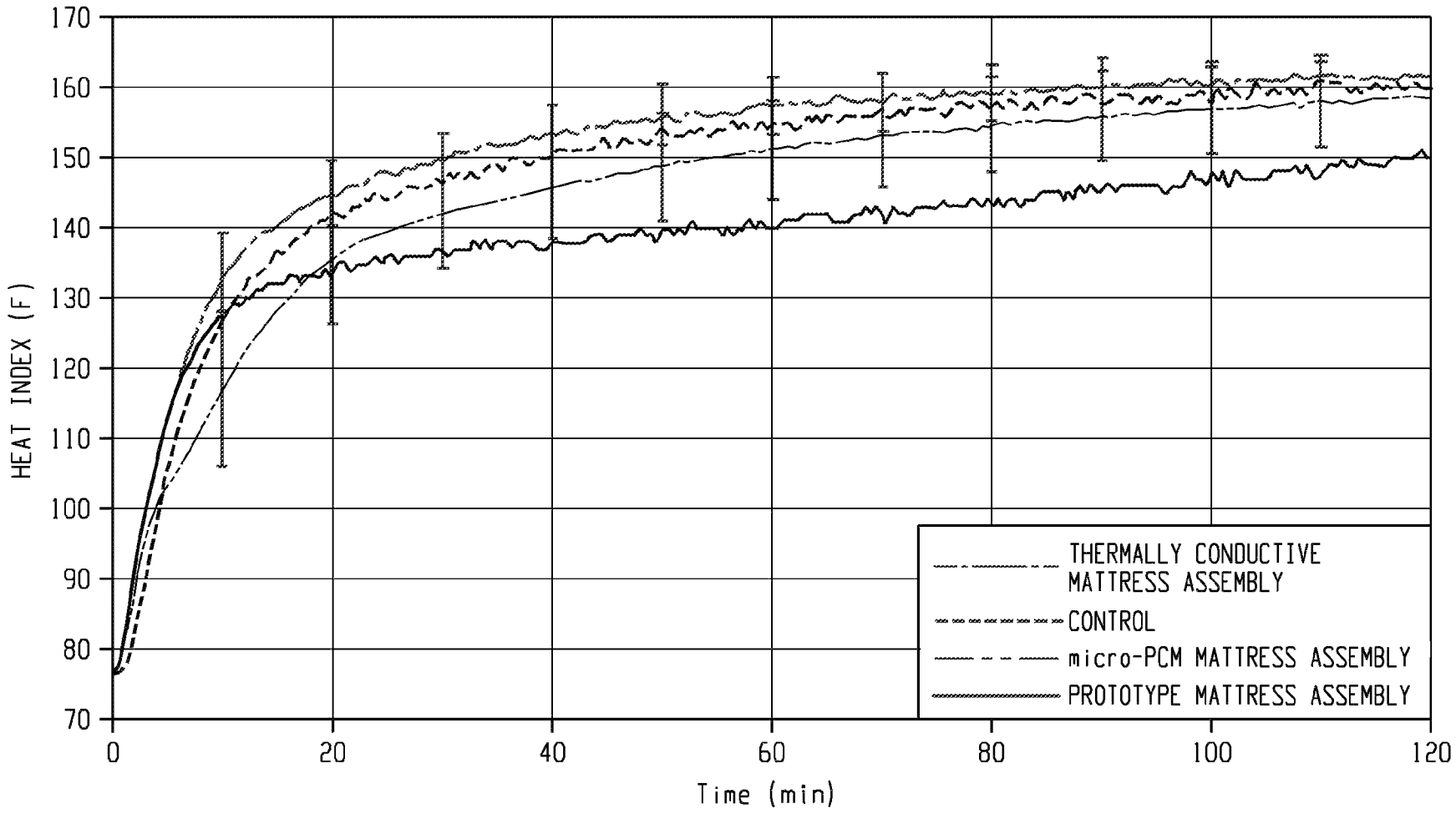
FIG. 11 graphically illustrates heat index as a function of time for various mattress assemblies compared to control mattress assemblies in accordance with an embodiment of the present disclosure.
Figure 12:
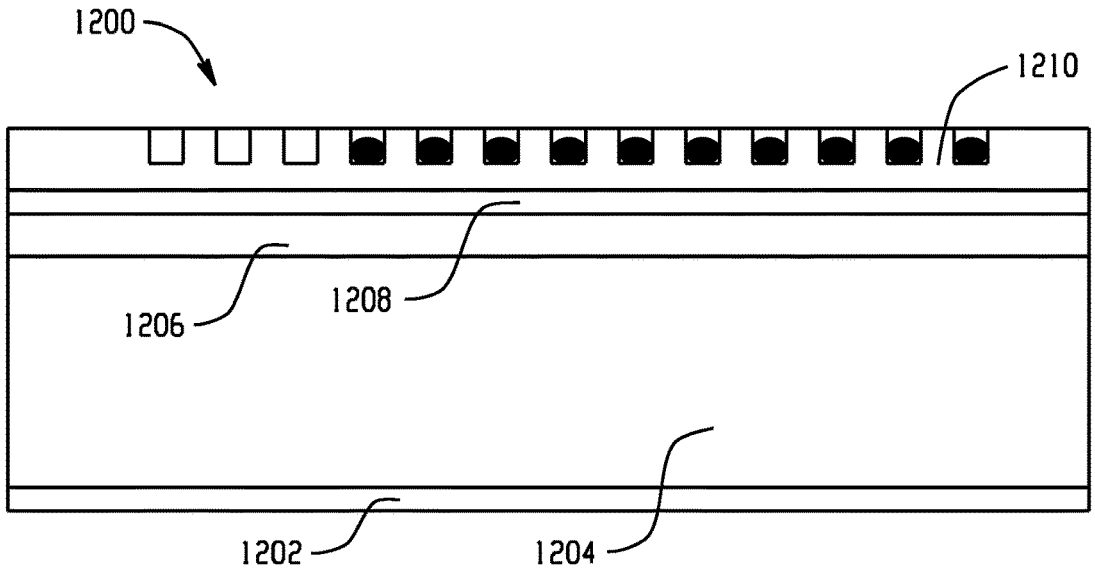
FIG. 12 illustrates a cross-sectional view of mattress assembly constructions used for comparing prototypical topper layers in accordance with an embodiment of the present disclosure compared to various prior art topper layers in the same mattress assembly construction.

FIGS. 9-11 graphically illustrate heat absorption, heat flux, and heat index as a function of time for mattress assemblies shown in FIG. 12. The mattress assemblies generally included a base polyurethane foam layer 1202, a coil unit or other type of support layer 1204 overlying the base layer 1202, foam layers 1206, 1208 overlying the support layer 1204, and a 3-inch foam topper layer 1210. The mattress assemblies were contained within a flame-retardant sock (not shown) including a phase change material coating on a surface thereof or a thermally conductive fabric thereof, where indicated. The mattress assemblies included variations of the topper layer 1210 and included a prototype topper; a control topper formed of polyurethane foam only without channels and without phase change material; a topper layer construction including microencapsulated phase change material on multiple surfaces; and a topper layer including a thermally conductive film in close proximity to the sleeping surface. The prototype topper layer in accordance with present disclosure included 10 one-pound tubes of an encapsulated coconut oil phase change material disposed within 2 inch channels as shown in FIG. 8.

Heat absorbance, heat index and heat flux were measured for the different mattress assemblies. The results clearly show that the prototype exhibited the most desirable behavior upon comparison of the measured heat absorption, heat index and heat flux as graphically shown in FIGS. 9, 10, and 11.

Figure 13:
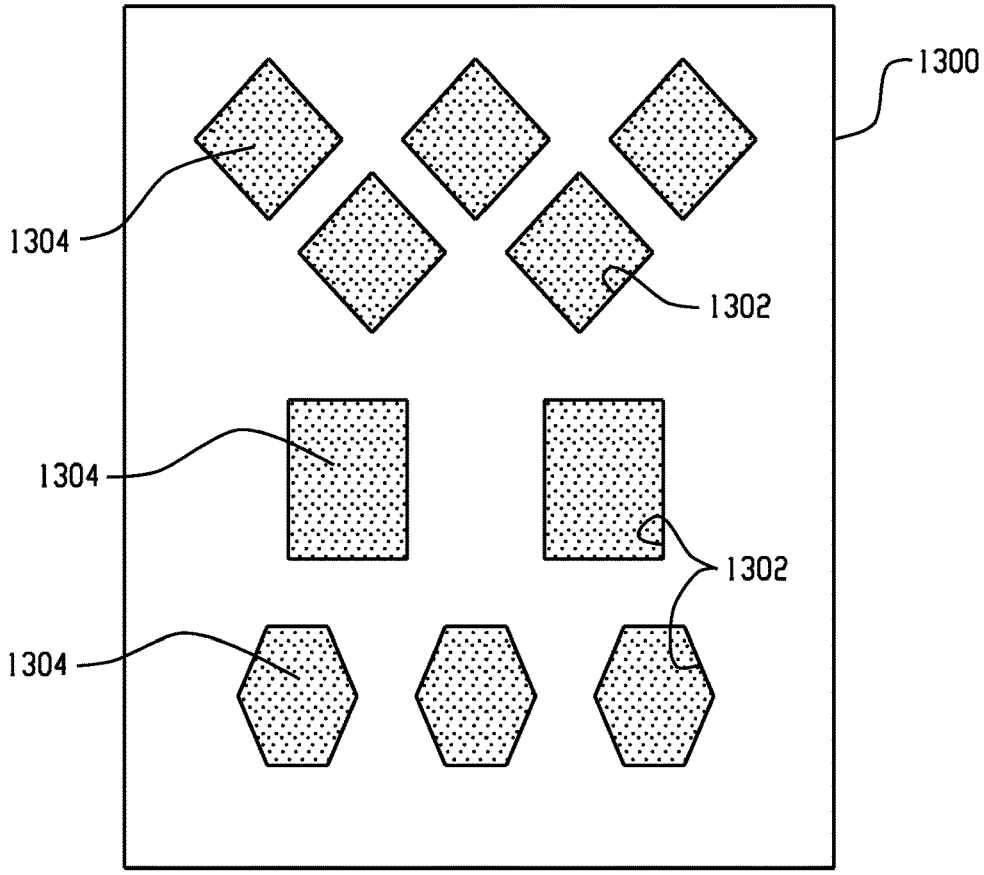
FIG. 13 illustrates a top-down view of a mattress assembly including at least one foam layer including one or more recesses within a selected surface of the at least one foam layer and an encapsulated bulk phase change material disposed therein in accordance with the present disclosure.

Referring now to FIG. 13, there is depicted a top-down view of a mattress assembly including at least one foam layer 1300 including one or more recesses 1302 formed within a selected surface of the at least one foam layer and an encapsulated bulk phase change material 1304 disposed therein in accordance with the present disclosure. The number and spacing between recesses is not intended to be limited nor are the recesses intended to be limited to any particular geometric shape or shapes. The recesses within the at least one layer 1300 can include multiple geometric shapes as shown or can be of a single geometric shape. The encapsulated bulk phase change material 1304 has a complementary shape to the recess shape and can be configured to fill the recess in its entirety or partially as previously described above to provide a space above the encapsulated bulk phase change material. Optionally, the recesses 1302 can extend through the entire width of the at least one foam layer provided a support layer is disposed underneath.

This written description uses examples to disclose the invention, including the best mode, and also to enable any person skilled in the art to make and use the invention. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A mattress assembly comprising:

at least one foam layer proximate to a sleeping surface of the mattress assembly, the at least one foam layer spanning at least a portion of a length and/or width of the sleeping surface and comprising:

a plurality of channels in a top surface linearly extending from one side to an opposing side of the at least one foam layer, wherein the top surface faces the sleeping surface, wherein each of the plurality of channels include a pair of vertical spaced apart walls extending perpendicularly from a bottom planar surface of the at least one foam layer, and wherein at least one or more of the plurality of channels are at different depths relative to one another within the top surface; and a tubular-shaped encapsulated bulk phase change material seated and partially filling multiple channels, wherein the encapsulated bulk phase change material comprises a sealed flexible capsulate containing a phase change material or a mixture of phase change materials having a length dimension of at least about one half of a width dimension of the mattress assembly, wherein the encapsulated bulk phase change material is independent from the at least one foam layer and has a height less than a depth of the channel to provide an empty space between the encapsulated bulk phase change material and the top surface, the tubular-shaped encapsulated bulk phase change material distributed in the plurality of channels in a staggered configuration such that a first portion of the plurality of channels having a first depth alternates between an empty configuration and a filled configuration, and a second portion of the plurality of channels having a second depth alternates between a filled configuration and an empty configuration, the channels in the first portion having the filled configuration vertically aligned to the channels in the second portion having the empty configuration.

2. The mattress assembly of claim 1, wherein the sealed flexible capsulate further comprises a permeable material infused with the phase change material or the mixture of phase change materials.

3. The mattress assembly of claim 2, wherein the permeable material comprises foam.

4. The mattress assembly of claim 1, wherein the phase change material comprises coconut oil.

5. The mattress assembly of claim 1, wherein the phase change material or the mixture of phase change materials has a melting point in a range of about 22° C. to about 36° C.

6. The mattress assembly of claim 1, wherein the phase change material or the mixture of phase change materials is selected to have a transition temperature less than a body temperature of an end user of the mattress assembly such that the phase change material or mixture of phase change material absorbs heat from the end user.

7. The mattress assembly of claim 1, wherein the at least one foam layer further comprises a plurality of channels in a bottom surface comprising encapsulated bulk phase change material at least partially filling one or more of the channels in the bottom surface.

8. The mattress assembly of claim 7, wherein the plurality of channels in the top surface are aligned with the plurality of channels in the bottom surface.

9. The mattress assembly of claim 7, wherein the plurality of channels in the top surface are in a staggered relationship relative to the plurality of channels in the bottom surface.

10. The mattress assembly of claim 1, wherein the plurality of channels in the top surface extends widthwise.

11. The mattress assembly of claim 1, wherein the at least one foam layer is a topper layer underlying a cover layer and overlying a mattress body to define the mattress assembly.

12. The mattress assembly of claim 1, wherein the wherein the encapsulated bulk phase change material further comprises a thermally conductive material within the sealed capsulate material to increase thermal conductivity relative to an encapsulated bulk phase change material without the thermally conductive material.

13. The mattress assembly of claim 1, wherein the encapsulated bulk phase change material in the channels are different and/or have different phase transition temperatures.

14. The mattress assembly of claim 1, wherein the mattress assembly is dimensioned to simultaneously accommodate two end users and the encapsulated bulk phase change materials disposed within the channels are arranged end-to-end including a space therebetween so as to correspond to a position of the two end users when in use.

15. The mattress assembly of claim 1, wherein the mattress assembly is dimensioned to simultaneously accommodate two end users and the encapsulated bulk phase change materials disposed within the channels continuously spanning from one side to an opposing side corresponding to a position of the two end users when in use.

16. The mattress assembly of claim 1, wherein the encapsulated bulk phase change material at least partially filling one or more of the channels correspond to a head region, a lumbar region, and/or a leg and foot region of an end user.

17. A mattress assembly comprising:

at least one foam layer proximate to a sleeping surface of the mattress assembly, the at least one foam layer spanning at least a portion of the length and/or width of the sleeping surface and comprising:

a plurality of recesses linearly extending from one side to an opposing side of the at least one foam layer in at least a top surface or in a layer near the top surface, wherein the top surface faces the sleeping surface, and wherein each of the recesses in the at least one foam layer includes a pair of vertical spaced apart walls extending perpendicularly from a bottom planar surface of the at least one foam layer; and a tubular-shaped encapsulated bulk phase change material seated in and partially filling multiple recesses, wherein the encapsulated bulk phase change material comprises a sealed flexible capsulate containing a phase change material or a mixture of phase change materials having a length dimension of at least about one half of a width dimension of the mattress assembly, wherein the encapsulated bulk phase change material is independent from the at least one foam layer and has a height less than a depth of the recess to provide an empty space between the encapsulated bulk phase change material and the top surface;

the tubular-shaped encapsulated bulk phase change material distributed in the plurality of recesses in a staggered configuration such that a first portion of the plurality of recesses having a first depth alternates between an empty configuration and a filled configuration, and a second portion of the plurality of recesses having a second depth alternates between a filled configuration and an empty configuration, the recesses in the first portion having the filled configuration vertically aligned to the recesses in the second portion having the empty configuration.

* * * * *